US008960435B1

(12) United States Patent
Rideout

(10) Patent No.: US 8,960,435 B1
(45) Date of Patent: Feb. 24, 2015

(54) STACKABLE AND LINKABLE CONTAINER SYSTEM

(71) Applicant: Caleb D. Rideout, Sahuarita, AZ (US)

(72) Inventor: Caleb D. Rideout, Sahuarita, AZ (US)

( * ) Notice: Subject to any disclaimer, the term of this patent is extended or adjusted under 35 U.S.C. 154(b) by 0 days.

(21) Appl. No.: 14/061,822

(22) Filed: Oct. 24, 2013

(51) Int. Cl.
*B65G 59/00* (2006.01)

(52) U.S. Cl.
USPC ..... 206/508; 221/281; 232/44

(58) Field of Classification Search
CPC ... B65H 3/00; B65D 21/0223; B65D 21/0204
USPC ..... 221/61, 281; 232/43.1, 44; 206/508; 220/23.4, 676
See application file for complete search history.

(56) References Cited

U.S. PATENT DOCUMENTS

| | | | | |
|---|---|---|---|---|
| 3,131,829 | A * | 5/1964 | Masser | 206/144 |
| 3,811,559 | A | 5/1974 | Carter | |
| 4,375,265 | A * | 3/1983 | van de Wetering et al. | 220/1.5 |
| 4,700,842 | A | 10/1987 | Grusin | |
| 5,328,052 | A | 7/1994 | Kizilos | |
| 5,769,229 | A | 6/1998 | Address et al. | |
| 5,794,817 | A * | 8/1998 | Rosa | 221/281 |
| 6,138,863 | A * | 10/2000 | Aiken | 220/819 |
| 6,659,305 | B2 | 12/2003 | Thompson | |
| 6,874,650 | B2 | 4/2005 | Welsh et al. | |
| 6,886,694 | B2 | 5/2005 | McNeeley et al. | |
| 7,900,797 | B1 | 3/2011 | Witcraft | |
| 8,136,697 | B2 | 3/2012 | Hackney | |
| 8,381,909 | B2 | 2/2013 | Hernandez et al. | |
| 2005/0151453 | A1 | 7/2005 | North | |
| 2009/0000977 | A1 | 1/2009 | Coonce | |
| 2009/0008284 | A1 | 1/2009 | Lown et al. | |
| 2013/0047558 | A1 | 2/2013 | Hogan | |

* cited by examiner

*Primary Examiner* — Stephen Castellano
(74) *Attorney, Agent, or Firm* — Shaddock Law Group, PC

(57) ABSTRACT

A stackable and linkable container system that includes a container having a cavity; an entry slot formed in at least an upper portion of the front wall; an exit slot formed in at least a lower portion of the front wall; a cover; one or more vertical stack aligning tabs extending from a top surface of the cover; one or more ribs extending from an outer surface of the bottom wall; at least one horizontal aligning dovetail extending from the first side wall; at least two, spaced apart, horizontal aligning pins extending from the second side wall, wherein at least one horizontal aligning dovetail socket is defined between the spaced apart horizontal aligning pins, and wherein the horizontal aligning dovetail is formed so as to be at least partially received within the horizontal aligning dovetail socket.

20 Claims, 16 Drawing Sheets

STACKABLE AND LINKABLE CONTAINER SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of storage devices. More specifically, the present invention relates to stackable containers to aid in the organization and storage of container lids and the like.

2. Description of Related Art

There are a number of storage container systems that are used in the preparation, storage, containment, and serving of various foods and food products. The container systems typically include various sized container and lid combinations that provide an airtight environment for food storage.

Such storage container systems typically include a plastic, ceramic, or glass container with an associated, substantially flexible plastic or rubber lid.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, storing the containers and associated lids in an organized fashion can be difficult, particularly when one or more sets or sizes of container/lid combinations are present. This often results in appropriate lids being difficult to locate when needed or lids being misplaced.

Thus, the various embodiments of the present invention provide a container system for organizing and housing various lids in a manner that makes them easily accessible. The present invention also provides a container system that is vertically stackable and horizontally linkable. The container system of the present invention allows similarly sized container lids can each be maintained within a single container system. Multiple container systems can be stacked atop one another or linked in a side-by-side fashion.

In various exemplary, non-limiting embodiments, the stackable and linkable container system comprises a container having a cavity, wherein the cavity is defined by inner surfaces of a first side wall, a second side wall, a front wall, a rear wall, and a bottom wall; an entry slot formed in at least an upper portion of the front wall; an exit slot formed in at least a lower portion of the front wall; a cover, wherein the cover is removably securable to a portion of the container via interaction between portions of the cover and mating projections extending from a forward portion of each of the opposed side walls and a portion of the rear wall; one or more vertical stack aligning tabs extending from a top surface of the cover; one or more ribs extending from an outer surface of the bottom wall, wherein at least a portion of the one or more ribs is capable of being aligned with and at least partially received within a portion of the one or more vertical stack aligning tabs; at least one horizontal aligning dovetail extending from the first side wall; at least two, spaced apart, horizontal aligning pins extending from the second side wall, wherein at least one horizontal aligning dovetail socket is defined between the spaced apart horizontal aligning pins, and wherein the horizontal aligning dovetail is formed so as to be at least partially received within the horizontal aligning dovetail socket.

In various exemplary embodiments, the cavity is configured so as to contain a plurality of container lids. The entry slot is formed in at least an upper portion of the front wall, an upper portion of the first side wall and an upper portion of the second side wall. In this manner, container lids can be inserted into the cavity, via the entry slot. The exit slot is formed in at least a lower portion of the front wall, a lower portion of the first side wall, and a lower portion of the second side wall. The exit slot is formed so that stored container lids can be removed from the cavity, one at a time.

In various exemplary embodiments, the at least one horizontal aligning dovetail extends from the first side wall proximate a top portion of the first side wall. The horizontal aligning pins extend from the second side wall proximate a top portion of the second side wall. This manner, a number of stackable and linkable containers can be horizontally linked together via interaction of the corresponding aligning dovetails and horizontal aligning dovetail sockets.

Accordingly, the presently disclosed invention provides a stackable and linkable container system that allows a user to stack a number of container lids within a single container.

The presently disclosed invention separately provides a stackable and linkable container system that allows a user to easily maintain multiple sized container lids within a container system.

The presently disclosed invention separately provides a stackable and linkable container system that allows a user to easily remove a single container lid from the container system when needed.

The presently disclosed invention separately provides a stackable and linkable container system that allows a user to easily insert container lids into the container system when needed.

The presently disclosed invention separately provides a stackable and linkable container system that accommodates various size container lids.

The presently disclosed invention separately provides a stackable and linkable container system that can be easily managed by a user.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
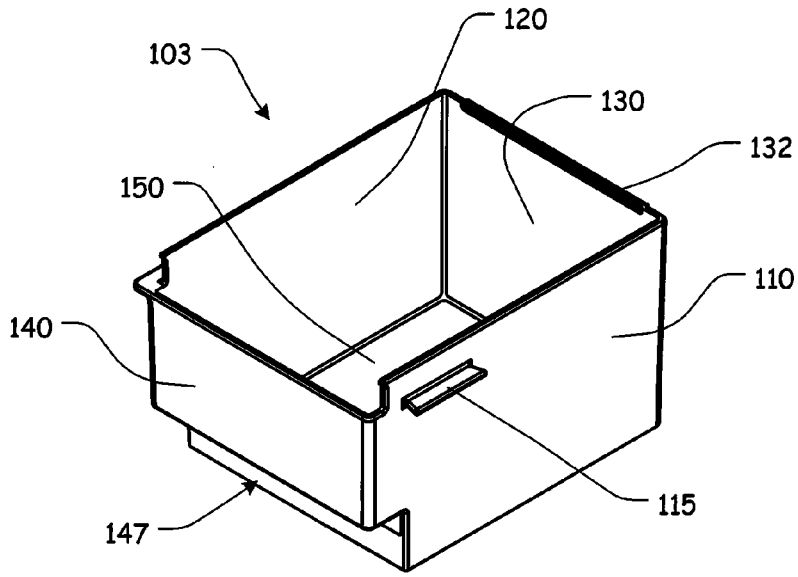
FIG. 1 illustrates a top perspective view of a first exemplary embodiment of a stackable and linkable container, according to this invention.
Figure 2:
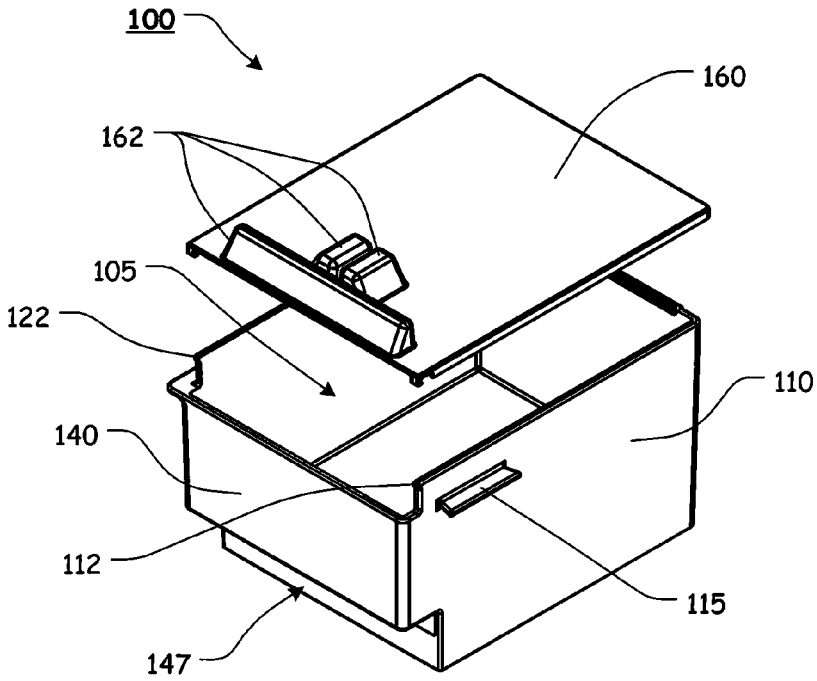
FIG. 2 illustrates a top perspective view of a first exemplary embodiment of a stackable and linkable container system, wherein the cover is removed from the container, according to this invention.
Figure 3:
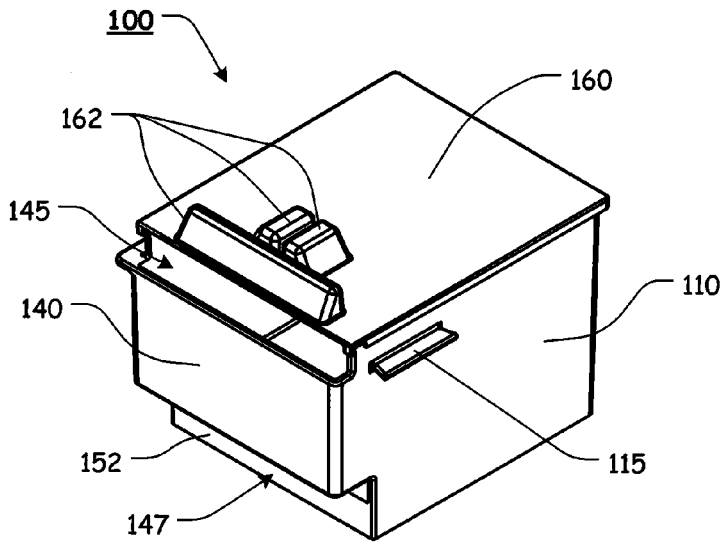
FIG. 3 illustrates a top perspective view of a first exemplary embodiment of a stackable and linkable container system, according to this invention.
Figure 4:
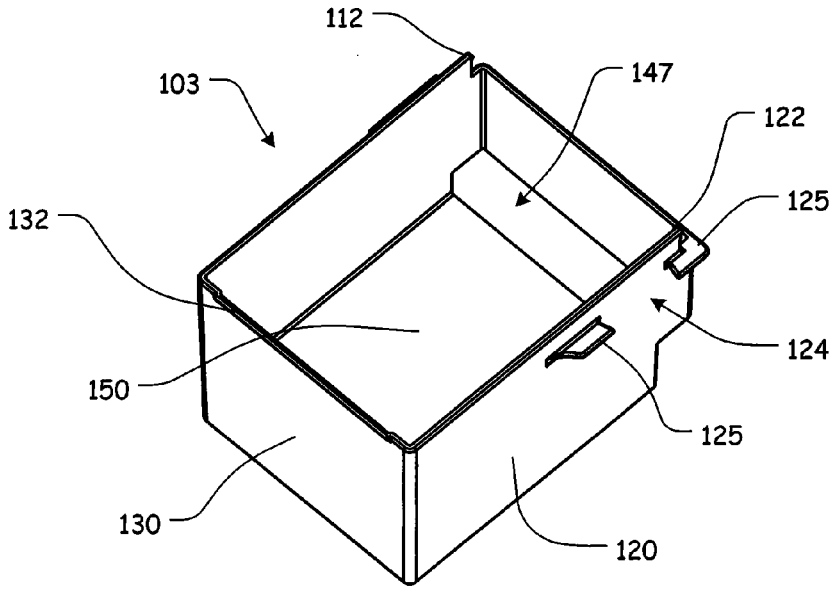
FIG. 4 illustrates a rear perspective view of a first exemplary embodiment of a stackable and linkable container, according to this invention.
Figure 5:
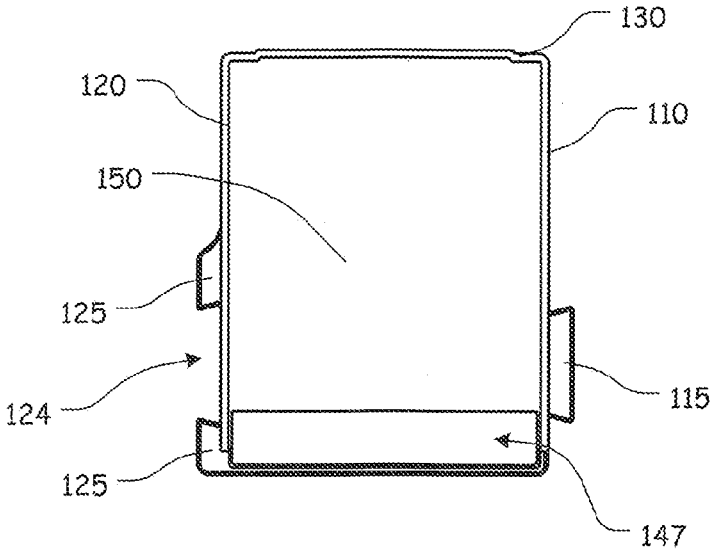
FIG. 5 illustrates a top view of a first exemplary embodiment of a stackable and linkable container, according to this invention.
Figure 6:
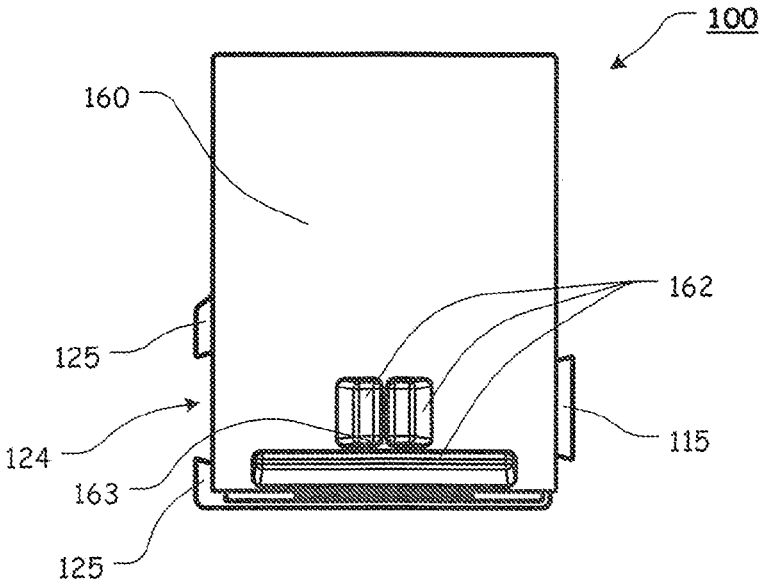
FIG. 6 illustrates a top view of a first exemplary embodiment of a stackable and linkable container system, according to this invention.
Figure 7:
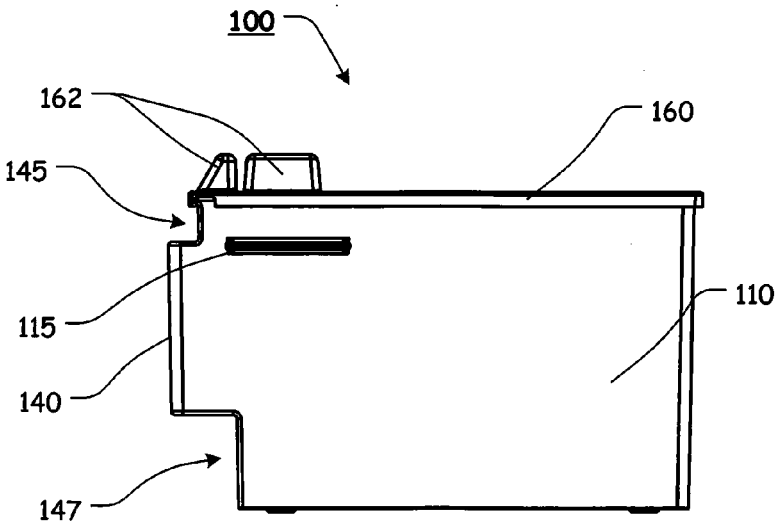
FIG. 7 illustrates a right side view of a first exemplary embodiment of a stackable and linkable container system, according to this invention.
Figure 8:
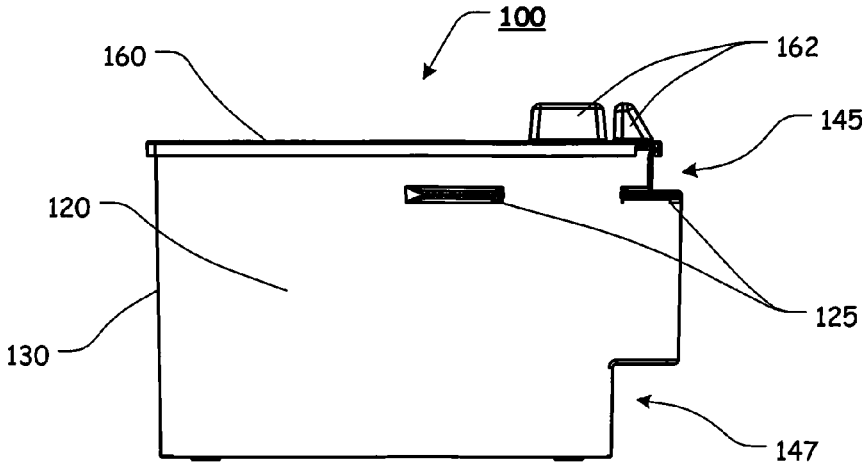
FIG. 8 illustrates a left side view of a first exemplary embodiment of a stackable and linkable container system, according to this invention.
Figure 9:
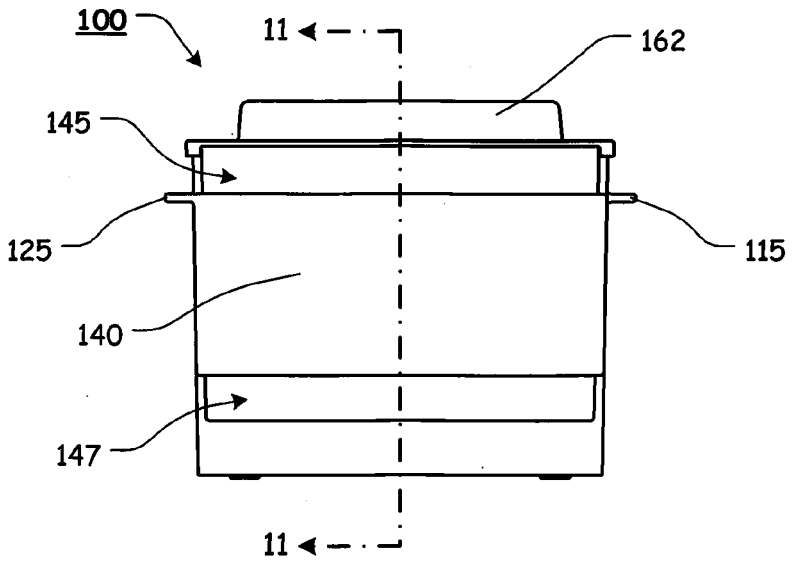
FIG. 9 illustrates a front view of a first exemplary embodiment of a stackable and linkable container system, according to this invention.
Figure 10:
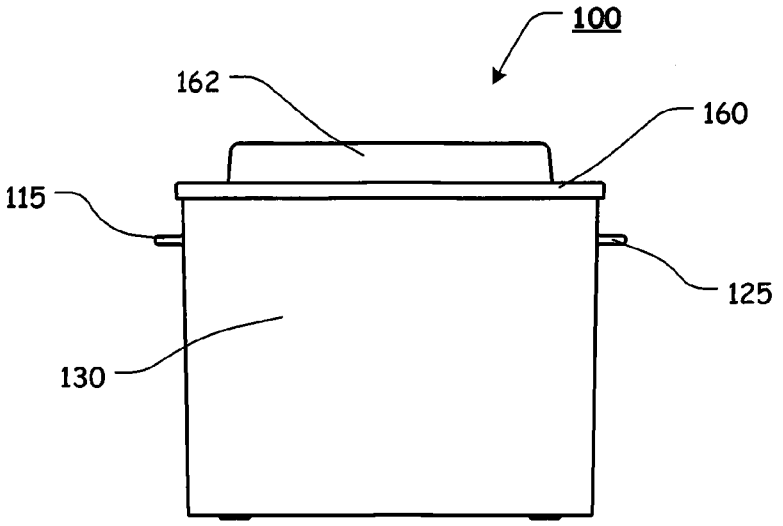
FIG. 10 illustrates a rear view of a first exemplary embodiment of a stackable and linkable container system, according to this invention.

For simplicity and clarification, the design factors and operating principles of the stackable and linkable container system according to this invention are explained with reference to various exemplary embodiments of stackable and linkable container system according to this invention. The basic explanation of the design factors and operating principles of the stackable and linkable container system is applicable for the understanding, design, and operation of the stackable and linkable container system of this invention. It should be appreciated that the stackable and linkable container system can be adapted to many applications where it is desirable to maintain container covers or other items in an organized and easily accessible manner.

It should also be appreciated that the terms "lid", "cover", "container", and "container system" are used for basic explanation and understanding of the operation of the systems, methods, and apparatuses of this invention. Therefore, the terms "lid", "cover", "container", and "container system" are not to be construed as limiting the systems, methods, and apparatuses of this invention. In particular, the term "container" is to be understood to broadly include any structure or device capable of containing a solid or liquid substance and the term "lid" is to be understood to broadly include any structure or device capable of being used to removably seal a container.

For simplicity and clarification, the stackable and linkable container system of this invention will be described as being used to contain and dispense exemplary lids. However, it should be appreciated that these are merely exemplary embodiments of the stackable and linkable container system and are not to be construed as limiting this invention. Thus, the stackable and linkable container system of this invention may be utilized to contain and dispense a variety of lids.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-19 illustrate certain elements and/or aspects of a first exemplary embodiment of the stackable and linkable container system 100, according to this invention. In illustrative, non-limiting embodiment(s) of this invention, as illustrated in FIGS. 1-19, the stackable and linkable container system 100 comprise at least some of a container 103 having a cavity 105.

The cavity 105 is defined by the interior facing or inner surfaces of a first side wall 110, a second side wall 120, a front wall 140, a rear wall 130, and a bottom wall 150. As illustrated, at least a portion of the first side wall 110, the second side wall 120, and the rear wall 130 extend below the interior facing surface of the bottom wall 150.

Figure 15:
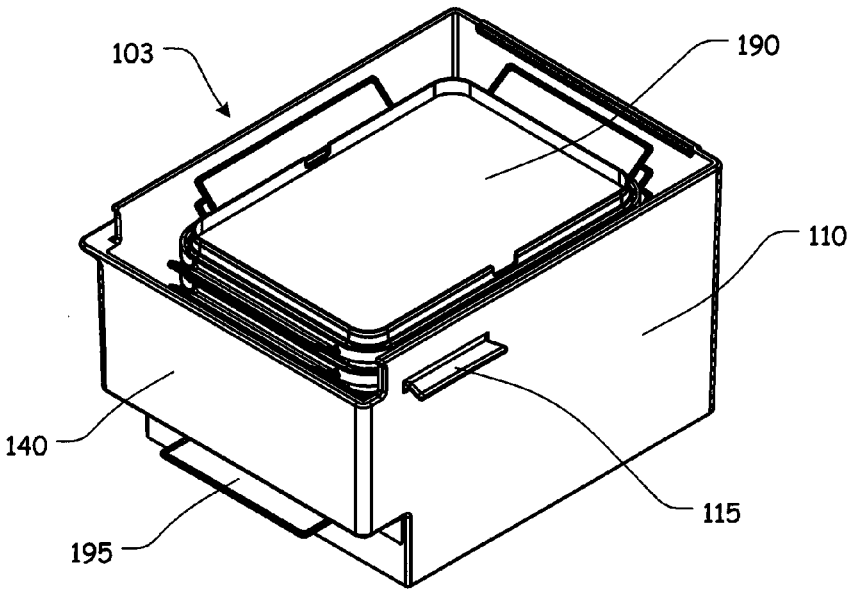
FIG. 15 illustrates a top perspective view of a first exemplary embodiment of a stackable and linkable container having a plurality of exemplary container lids contained within the cavity of the stackable and linkable container, according to this invention.
Figure 16:
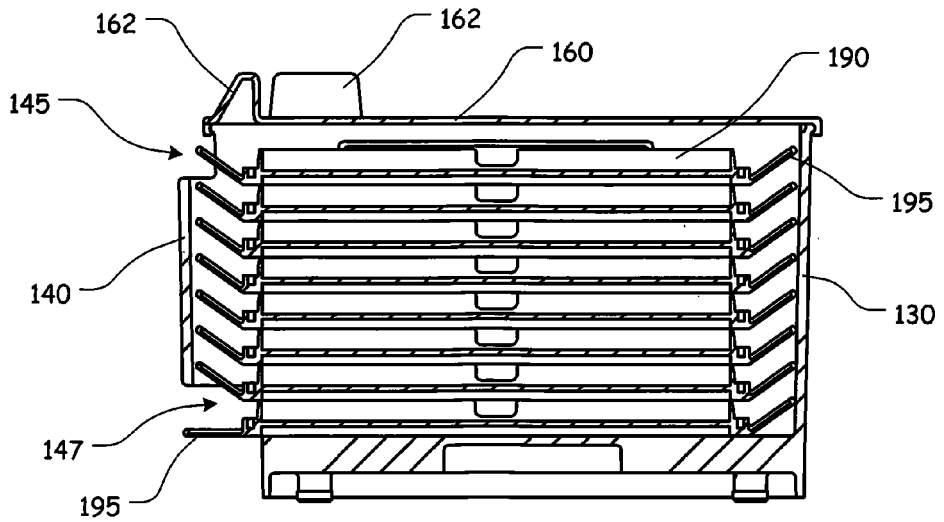
FIG. 16 illustrates a right side cross-sectional view, taken along line 11-11 of the stackable and linkable container system of FIG. 9, having a plurality of exemplary container lids contained within the cavity of the stackable and linkable container, according to this invention.
Figure 17:
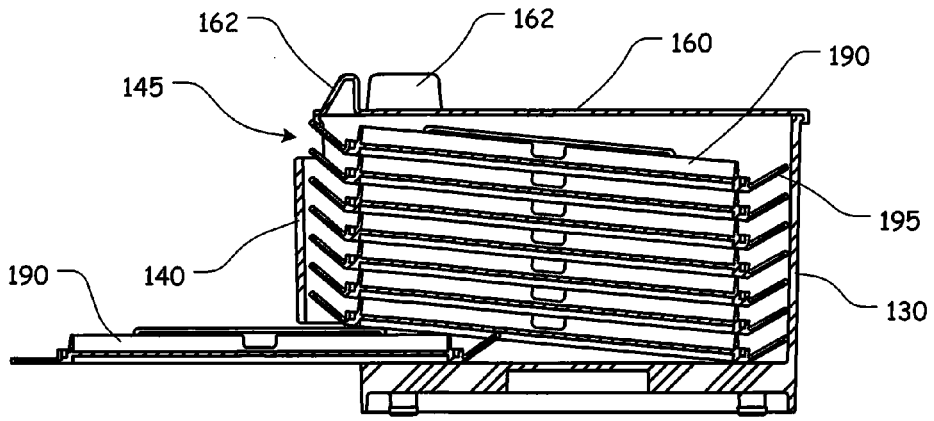
FIG. 17 illustrates a right side cross-sectional view, taken along line 11-11 of the stackable and linkable container system of FIG. 9, having a plurality of exemplary container lids contained within the cavity of the stackable and linkable container, wherein one of the exemplary container lids is being removed from the stackable and linkable container, according to this invention.
Figure 18:
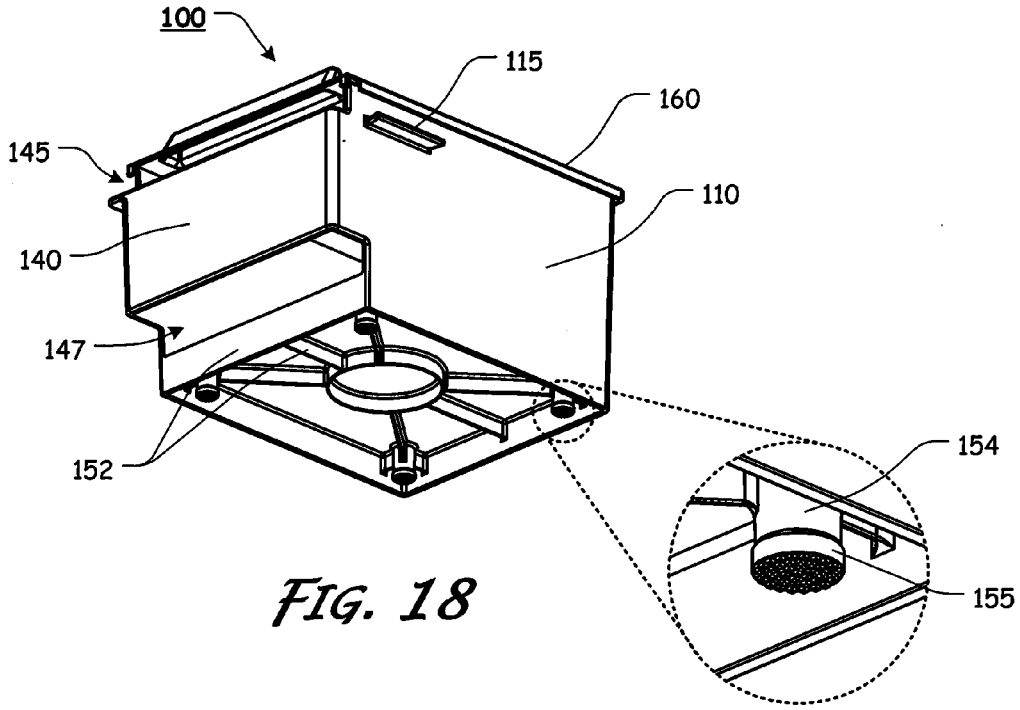
FIG. 18 illustrates a first bottom perspective view of a first exemplary embodiment of a stackable and linkable container system, according to this invention.
Figure 19:
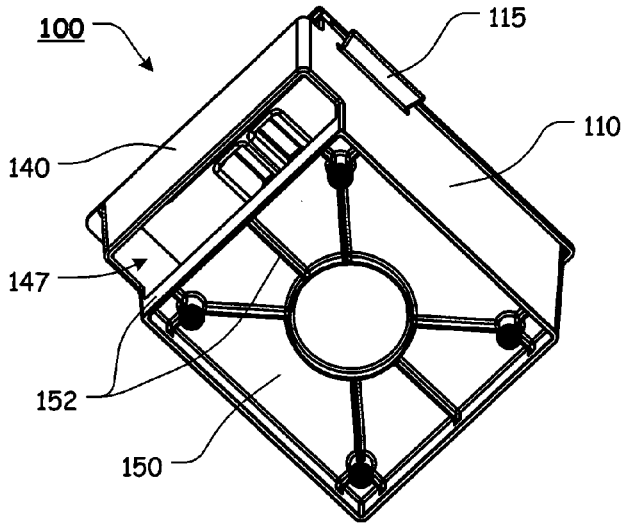
FIG. 19 illustrates a second bottom perspective view of a first exemplary embodiment of a stackable and linkable container system, according to this invention.
Figure 20A:
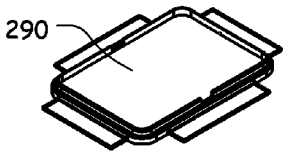
FIG. 20A illustrates a perspective view of a second exemplary container lid.
Figure 20B:
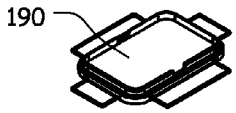
FIG. 20B illustrates a perspective view of a first exemplary container lid.
Figure 20C:
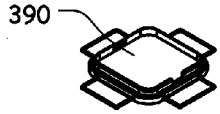
FIG. 20C illustrates a perspective view of a third exemplary container lid.
Figure 21A:
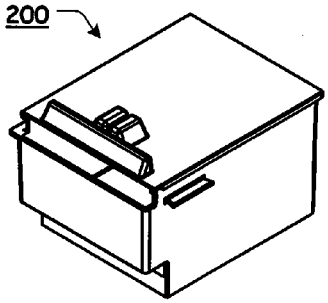
FIG. 21A illustrates a top perspective view of a second exemplary embodiment of a stackable and linkable container system, according to this invention.
Figure 21B:
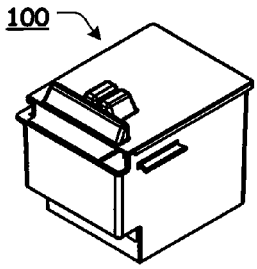
FIG. 21B illustrates a top perspective view of a first exemplary embodiment of a stackable and linkable container system, according to this invention.
Figure 21C:
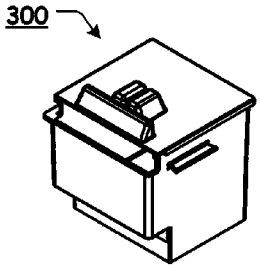
FIG. 21C illustrates a top perspective view of a third exemplary embodiment of a stackable and linkable container system, according to this invention.
Figure 22A:
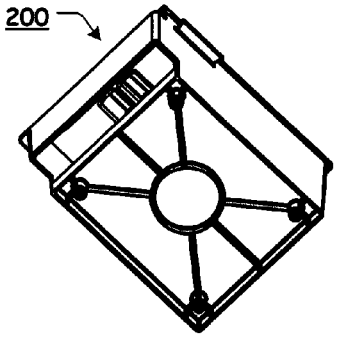
FIG. 22A illustrates a bottom perspective view of a second exemplary embodiment of a stackable and linkable container system, according to this invention.
Figure 22B:
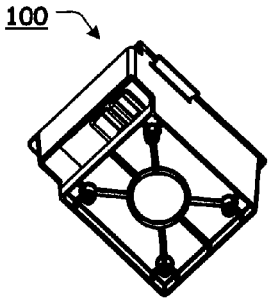
FIG. 22B illustrates a bottom perspective view of a first exemplary embodiment of a stackable and linkable container system, according to this invention.
Figure 22C:
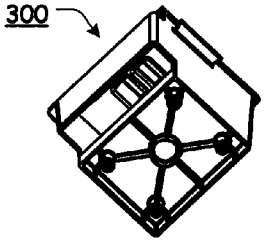
FIG. 22C illustrates a bottom perspective view of a third exemplary embodiment of a stackable and linkable container system, according to this invention.
Figure 23:
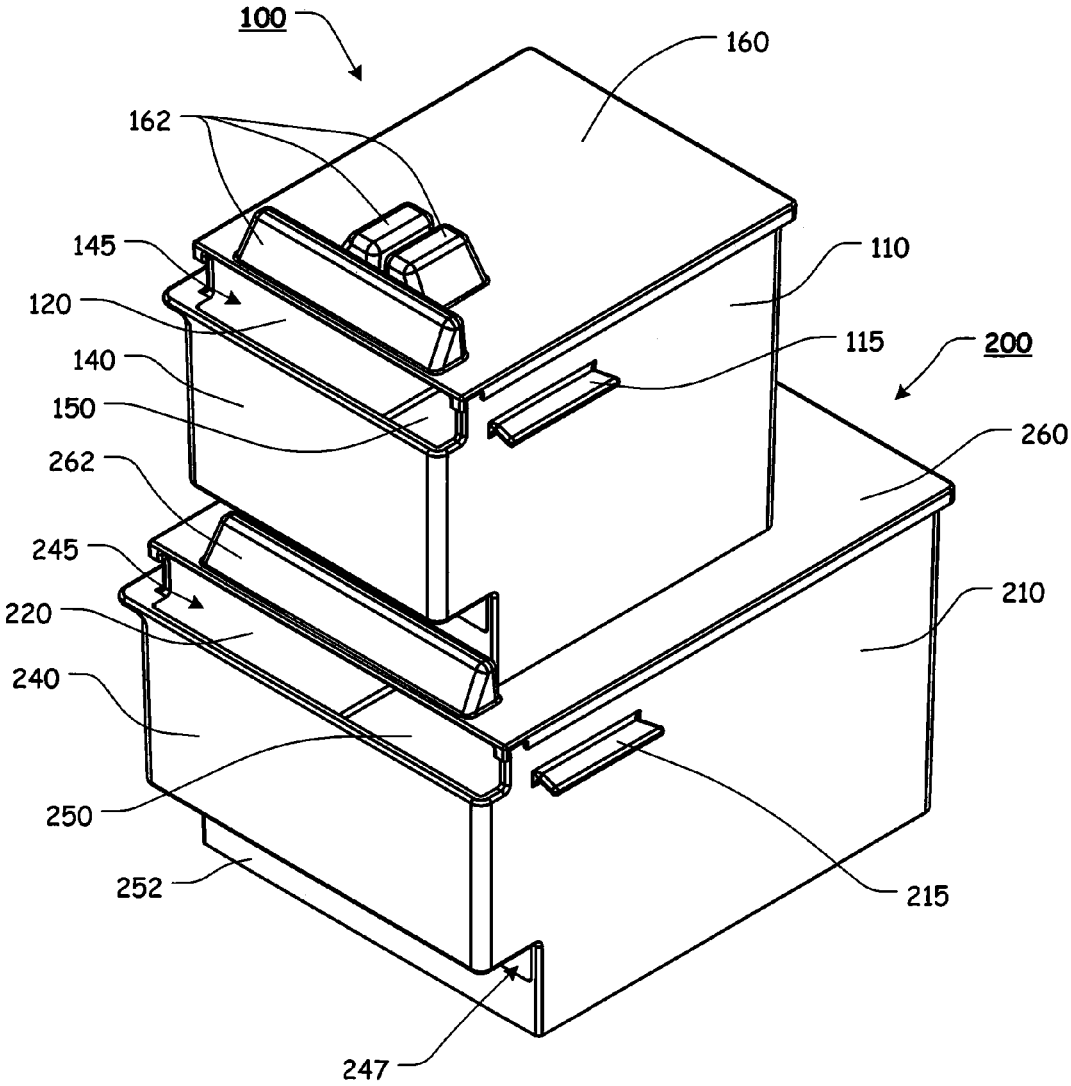
FIG. 23 illustrates a top perspective view of a first exemplary embodiment of a stackable and linkable container system stacked atop a second exemplary embodiment of a stackable and linkable container system, according to this invention.
Figure 24:
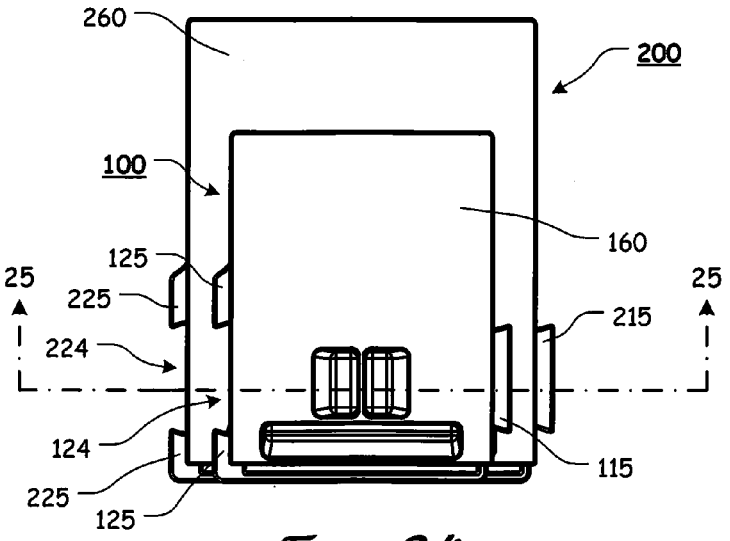
FIG. 24 illustrates a top view of a first exemplary embodiment of a stackable and linkable container system stacked atop a second exemplary embodiment of a stackable and linkable container system, according to this invention.
Figure 25:
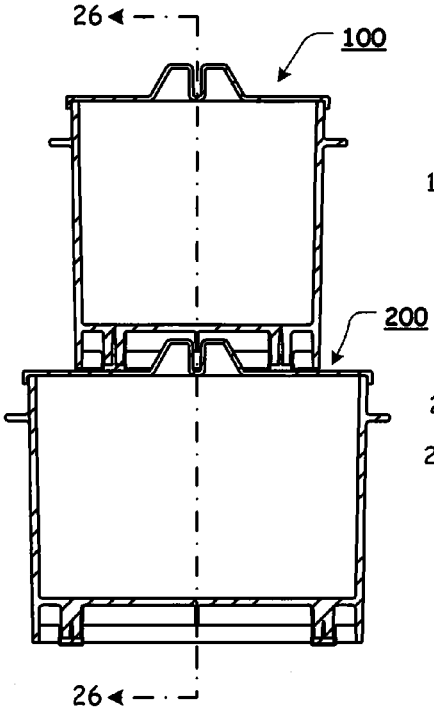
FIG. 25 illustrates a front cross-sectional view, taken along line 25-25 of FIG. 24, of a first exemplary embodiment of a stackable and linkable container system stacked atop a second exemplary embodiment of a stackable and linkable container system, according to this invention.
Figure 26:
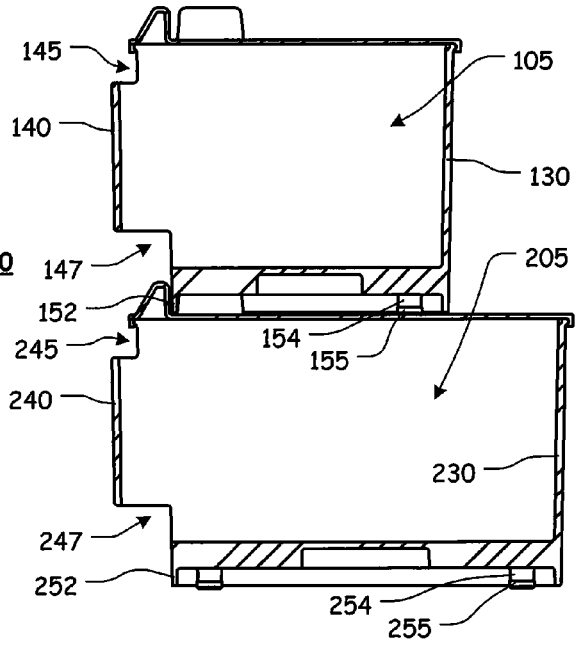
FIG. 26 illustrates a right side cross-sectional view, taken along line 26-26 of FIG. 25, of a first exemplary embodiment of a stackable and linkable container system stacked atop a second exemplary embodiment of a stackable and linkable container system, according to this invention.

The cavity 105 is configured so as to contain a plurality of container lids 190, as illustrated most clearly in FIGS. 15-17. As illustrated, each of the exemplary container lids 190 includes a tab 195 extending from a side of the container lid 190. As is known to one of ordinary skill in the art, the tabs 195 are hingedly connected to the container lid 190, such that when the container lid 190 is fitted atop an appropriate container, the tabs 195 can be urged to a latched position to engage a recess or other surface preparation on the appropriate container. This helps to ensure a secure connection between the container lid 190 and the appropriate container.

In various exemplary embodiments, the cavity 105 is formed such that when the container lids 190 are placed within the cavity 105, the tabs 195 flex or fold to act as spring tabs, centering the container lids 190 inside the cavity 105 of the container 103.

Figure 11:
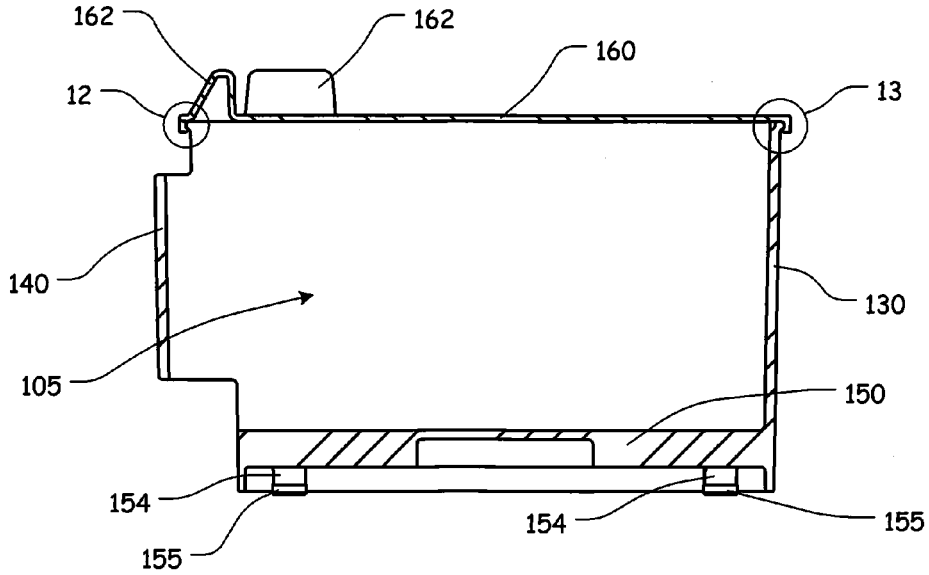
FIG. 11 illustrates a right side cross-sectional view, taken along line 11-11, of the stackable and linkable container system of FIG. 9.
Figure 12:
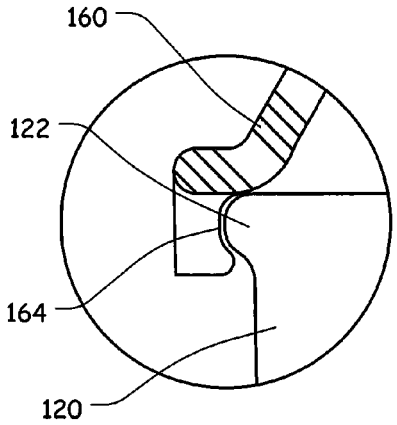
FIG. 12 illustrates a more detailed cutaway view of a first exemplary embodiment of a stackable and linkable container system, detailing the snap fit of a portion of the cover to a front portion of the container, according to this invention.
Figure 13:
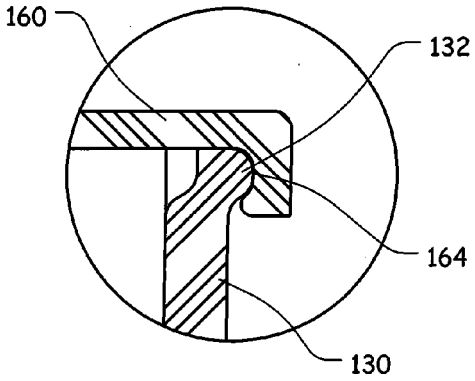
FIG. 13 illustrates a more detailed cutaway view of a first exemplary embodiment of a stackable and linkable container system, detailing the snap fit of a portion of the cover to a rear portion of the container, according to this invention.
Figure 14:
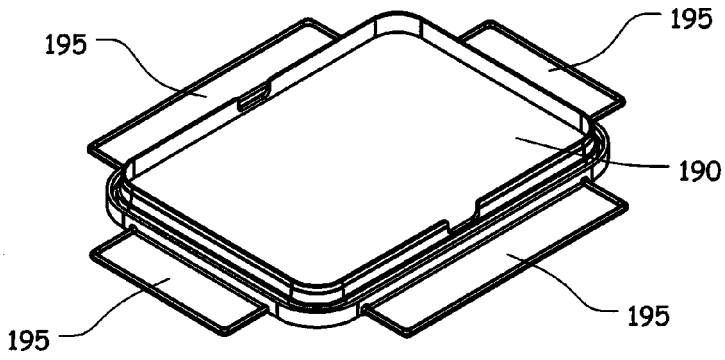
FIG. 14 illustrates a perspective view of an exemplary container lid.

In various exemplary embodiments, as illustrated most clearly in FIGS. 11-13, the cover 160 is removably securable atop the container 103 via interaction between portions of one or more ears or recesses 164 formed in the cover 160 and mating bumps or projections 112 and 122 extending from a forward portion of each of the first side wall 110 and the second side wall 120, respectively, and a mating bump or projection 132 extending from a portion of the rear wall 130.

Because of the interaction between the one or more recesses 164 and the projection 112, 122, and 132, the cover 160 can be snapped fitted atop the container 103.

It should be appreciated, however, that in certain exemplary embodiments, the cover 160 is merely fitted atop the container 103 and held in position by the weight of the cover 160 and certain overlapping portions of the cover 160 that overlap interior and/or exterior portions of the first side wall 110, a second side wall 120, and/or rear wall 130.

In various exemplary, nonlimiting embodiments, the cover 160 includes one or more vertical stack aligning tabs 162 extending from a top surface of the cover 160. Areas between the vertical stack aligning tabs 162 define one or more grooves 163.

An entry slot 145 is formed in at least an upper portion of the front wall 140. In various exemplary embodiments, the entry slot 145 is formed in at least an upper portion of the front wall 140, an upper portion of the first side wall 110, and an upper portion of the second side wall 120.

It should be appreciated that container lids 190 can be placed directly into the cavity 105 if the cover 160 is not present. If the cover 160 is fitted atop the container 103, the entry slot 145 allows access to and communication with the cavity 105. If a cover 160 is in place atop the container 103, the entry slot 145 allows container lids 190 to be inserted into the cavity 105. In certain exemplary embodiments, the entry slot 145 is formed so as to allow only a single container lid 190 to be aligned with and directed through the entry slot 145 at a time. Alternatively, the entry slot 145 may be formed so as to allow multiple container lids 190 to be directed through the entry slot at the same time.

As successive container lids 190 are directed through the entry slot 145 (or placed in the cavity 105, if the cover 160 is not present), the container lids 190 are stacked atop one another and generally centered within the cavity 105.

The exit slot 147 is formed in at least a lower portion of the front wall 140. In various exemplary embodiments, the exit slot 147 is formed in at least a lower portion of the front wall 140, a lower portion of the first side wall 110, and a lower portion of the second side wall 120. In various exemplary embodiments, the exit slot 147 is formed so that the container lids 190 can be removed from the cavity 105, one at a time.

As illustrated most clearly in FIGS. 15 and 16, when the container lids 190 are placed within the cavity 105, a tab 195 or a portion of the bottommost container lid 190 may extend through the exit slot 147. In this manner, the bottommost container lid 190 is easily accessible and can easily be grasped and withdrawn from the cavity 105, as illustrated in FIG. 17.

Once a bottommost container lid 190 is removed from the stackable and linkable container system 100, the next lowest container lid 190 is gravity fed downward in the cavity 105 to become the bottommost container lid 190.

In various exemplary, nonlimiting embodiments, one or more ribs 152 extend from an outer surface of the bottom wall 150. The ribs 152 provide additional rigidity to the bottom wall 150. At least a portion of the one or more ribs 152 is formed so as to the capable of being aligned with and at least partially received within a portion of the one or more vertical stack aligning grooves 163.

Through the mating interaction of the ribs 152 of a first stackable and linkable container system 100 and the vertical stack aligning grooves 163 of a second stackable and linkable container system 100, various embodiments of the stackable and linkable container system 100 can be aligned and stacked vertically in a manner that prevents the top stackable and linkable container system 100 from falling off of the bottom stackable and linkable container system 100.

In certain exemplary embodiments, a front face rib 152 interacts with a vertical stack aligning groove 163 so as to maintain vertically stacked stackable and linkable container systems in front to back lateral alignment. Front to back lateral alignment can keep the stacked stackable and linkable container systems from sliding relative to one another when a container lid 190 is being placed within the entry slot 145 or pulled from the exit slot 147.

Similarly, an interior rib 152 interacts with a vertical stack aligning groove 163 so as to maintain vertically stacked stackable and linkable container systems in side to side lateral alignment. Side to side lateral alignment can center stacked stackable and linkable container systems atop one another.

A plurality of feet 154 may optionally extend from a bottom surface of the bottom wall 150. The feet 154 provide stabilizing and/or balancing services for the stackable and linkable container system 100. In certain exemplary embodiments, a rubber footpad 155 is fitted to the bottom of each foot 154. In this manner, a gripping surface can be provided to each foot 154 so that the container 103 is less likely to slip or skid on a surface.

In various exemplary, nonlimiting embodiments, at least one horizontal aligning dovetail 115 extends from the first side wall 110. While the horizontal aligning dovetail 115 is illustrated as having a generally trapezoidal shape, it should be appreciated that the horizontal aligning dovetail 115 may take other shapes, such as, for example, a teardrop, oval, or other desired shape.

At least two, spaced apart, horizontal aligning pins 125 extend from the second side wall 120. The spaced apart horizontal aligning pins 125 define at least one horizontal aligning dovetail socket 124 in an area between the spaced apart horizontal aligning pins 125. The horizontal aligning dovetail socket 124 is shaped so as to be a complementary shape to the shape of the at least one horizontal aligning dovetail 115. In this manner, the horizontal aligning dovetail 115 of a first stackable and linkable container system 100 can be aligned with and received at least partially within the horizontal aligning dovetail socket 124 of a second stackable and linkable container system 100. This manner, a number of stackable and linkable containers 103 can be horizontally linked together via interaction of the corresponding aligning dovetails 115 and horizontal aligning dovetail sockets 124.

While the at least one horizontal aligning dovetail 115 is illustrated as extending from the first side wall 110 and the horizontal aligning pins 125 are illustrated as extending from the second side wall 120, it should be appreciated that the dovetail 115 and aligning pins 125 may extend from either the first side wall 110 or the second side wall 120, so long as they each extend from different side walls.

Likewise, while the at least one horizontal aligning dovetail 115 is illustrated as being located proximate a top portion of the first side wall 110 and the horizontal aligning pins 125 are illustrated as being located proximate a top portion of the second side wall 120, it should be appreciated that the dovetail 115 and the aligning pins 125 may be located at any desired position along the respective side walls, so long as the dovetail 115 and the aligning pins 125 are located so as to allow the horizontal aligning dovetail 115 of a first stackable and linkable container system 100 to be aligned with and received at least partially within the horizontal aligning dovetail socket 124 of a second stackable and linkable container system 100.

In various exemplary embodiments, various components of the stackable and linkable container system 100 are substantially rigid and are formed of plastic. Alternate materials of construction of the various components of the stackable and linkable container system 100 may include one or more of the following: wood, steel, stainless steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the stackable and linkable container system 100 is a design choice based on the desired appearance and functionality of the stackable and linkable container system 100.

It should be appreciated that certain elements of the stackable and linkable container system 100 may be formed as an integral unit (such as, for example, the container 103 and the cover 160). Alternatively, suitable materials can be used and sections or elements made independently and attached or coupled together, such as by adhesives, welding, screws, rivets, pins, or other fasteners, to form the various elements of the stackable and linkable container system 100.

It should also be understood that the overall size and shape of the stackable and linkable container system 100, and the various portions thereof, is a design choice based upon the desired functionality and/or appearance of the stackable and linkable container system 100. Thus, as illustrated in FIGS. 20A-22C, the container lids 190 can come in a variety of shapes and sizes, such as, for example, a comparatively larger lid 290 or a comparatively smaller lid 390. It should be appreciated that the overall size and shape of the container lid 190, 290, or 390 is a design choice based upon the desired use and functionality of the particular container lid.

Using the principles of the present invention, the overall size, shape, and dimensions of the stackable and linkable container system 100 can be varied to produce, for example, a comparatively larger container system 200 or a comparatively smaller container system 300. It should be understood and appreciated that the overall size, shape, and dimensions of a container system according to this invention can be based upon used with a desired size and shape of container lids.

For example, FIGS. 23-26 illustrate a stackable and linkable container system 100 stacked atop a stackable and linkable container system 200, according to this invention. As shown in FIGS. 23-26, the stackable and linkable container system 200 comprises at least some of a container 203, a cavity 205, a first side wall 210, a projection 212, at least one horizontal aligning dovetail 215, a second side wall 220, a projection 222, at least one horizontal aligning dovetail socket 224, at least two horizontal aligning pins 225, a rear wall 230, a projection 232, a front wall 240, an entry slot 245, an exit slot 247, a bottom wall 250, one or more ribs 252, a plurality of feet 254, a rubber footpad 255, a cover 260, one or more vertical stack aligning tabs 262, one or more grooves 263, and one or more recesses 264.

It should be understood that each of these elements corresponds to and operates similarly to the stackable and linkable container system 100, the container 103, the cavity 105, the first side wall 110, the projection 112, the at least one horizontal aligning dovetail 115, the second side wall 120, the projection 122, the at least one horizontal aligning dovetail socket 124, the at least two horizontal aligning pins 125, the rear wall 130, the projection 132, the front wall 140, the entry slot 145, the exit slot 147, the bottom wall 150, the one or more ribs 152, the plurality of feet 154, the rubber footpad 155, the cover 160, the one or more vertical stack aligning tabs 162, the one or more grooves 163, and the one or more recesses 164, as described above with reference to the stackable and linkable container system 100 of FIGS. 1-19.

However, as illustrated in FIGS. 23-26, the stackable and linkable container system 200 is comparatively larger than the stackable and linkable container system 100, so that container lids 290 (optionally including tabs 295) can be stored therein. However, through the mating interaction of the ribs 152 and the vertical stack aligning grooves 263, the stackable and linkable container system 100 can be aligned with and vertically stacked atop the stackable and linkable container system 200.

Figure 27:
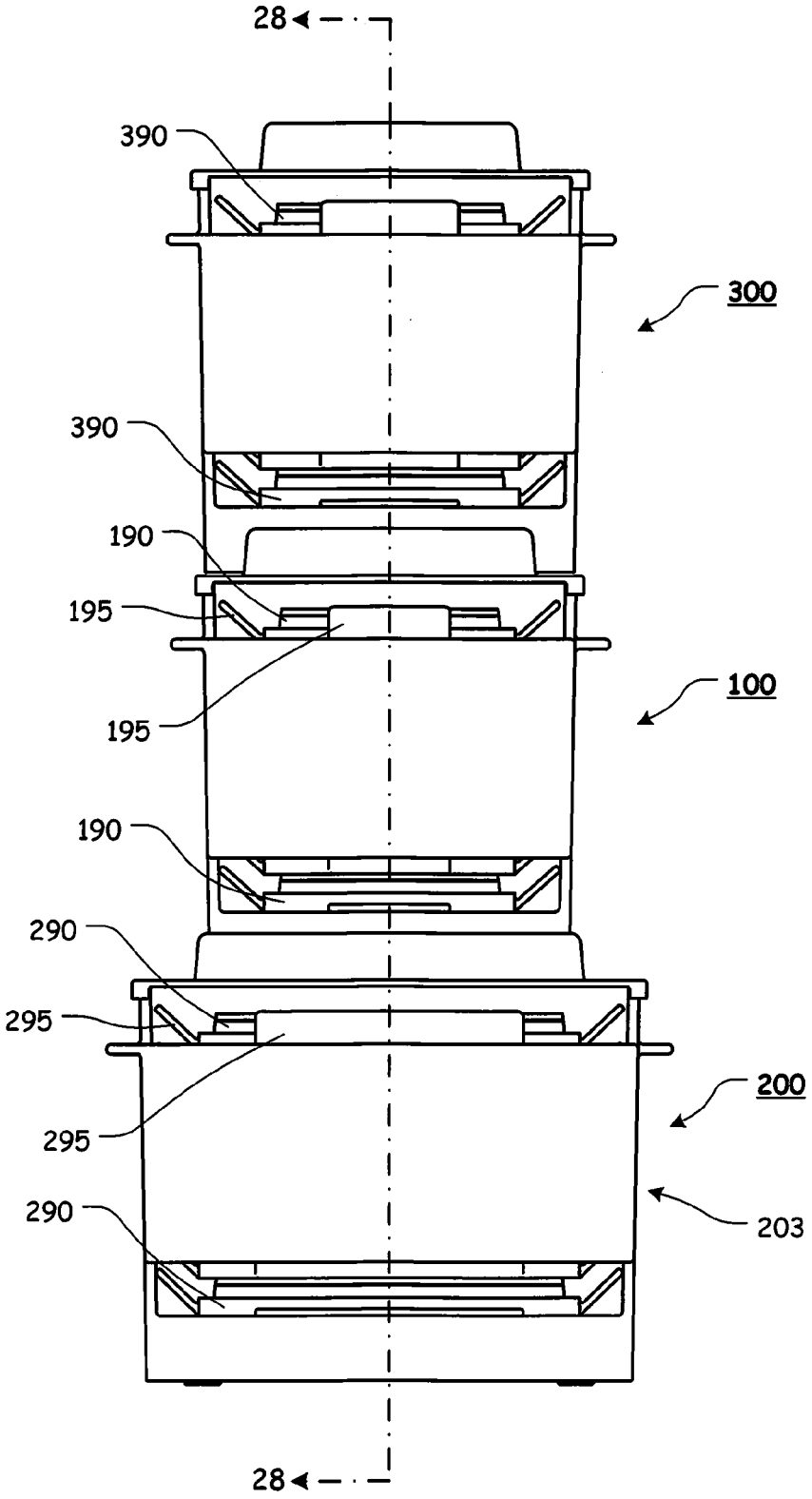
FIG. 27 illustrates a front view of a third exemplary embodiment of a stackable and linkable container system stacked atop a first exemplary embodiment of a stackable and linkable container system stacked atop a second exemplary embodiment of a stackable and linkable container system, according to this invention.

Likewise, as illustrated in FIG. 27, through the mating interaction of the ribs 152 and the vertical stack aligning grooves 163 and 263, multiple stackable and linkable container systems 100 can be aligned with and vertically stacked atop one another and the stackable and linkable container system 200.

Figure 28:
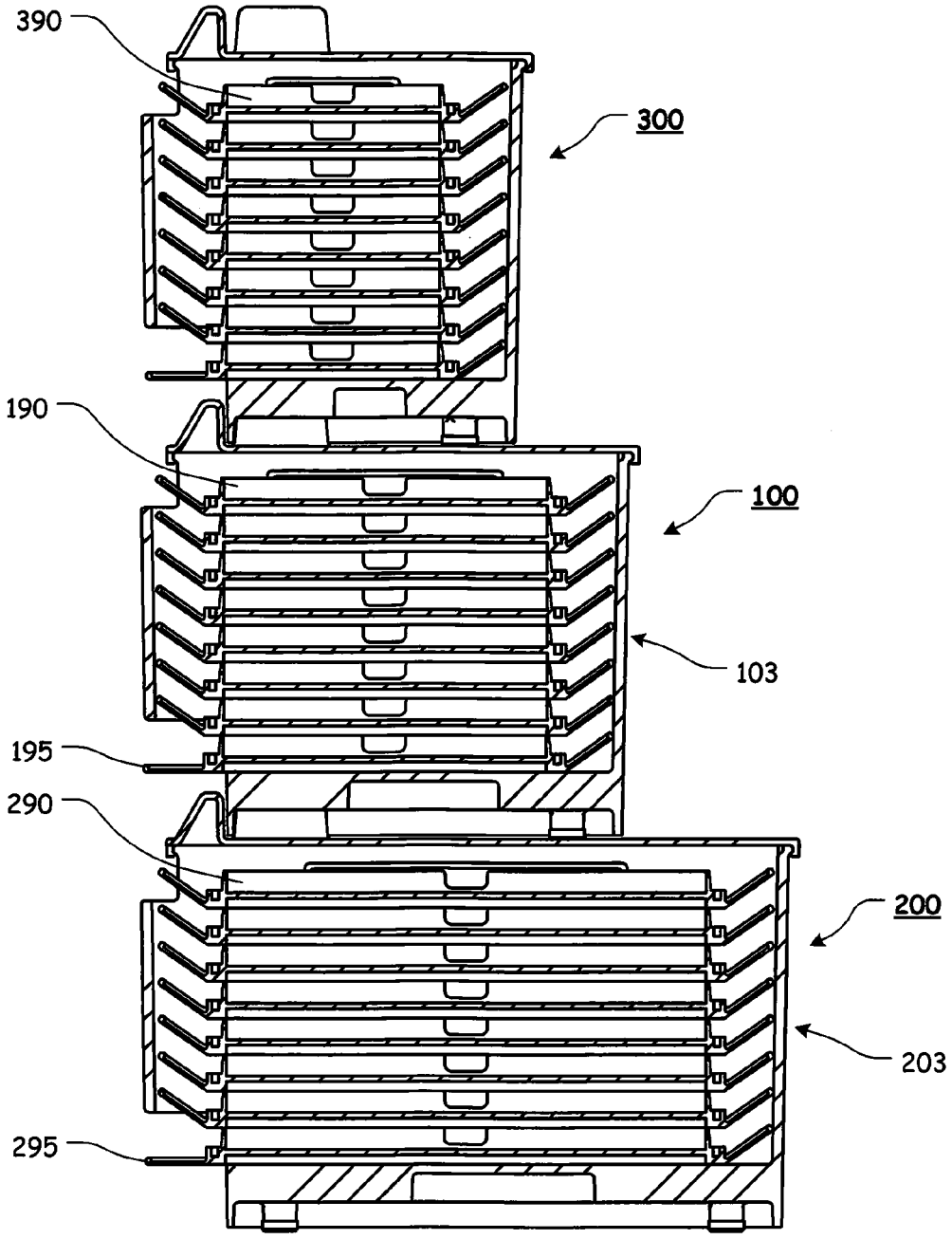
FIG. 28 illustrates a right side cross-sectional view, taken along line 28-28, of the stacked, stackable and linkable container systems of FIG. 27.
Figure 29:
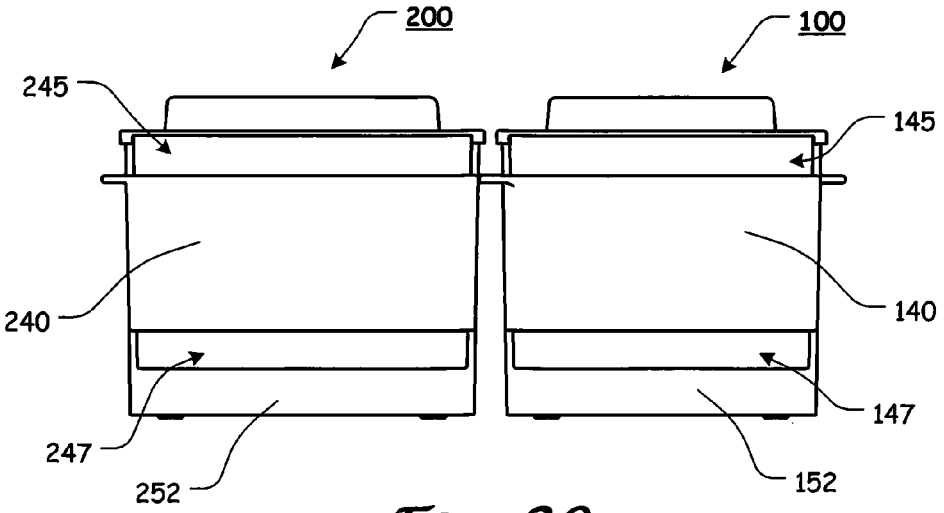
FIG. 29 illustrates a front view of a first exemplary embodiment of a stackable and linkable container system horizontally linked to a second exemplary embodiment of a stackable and linkable container system, according to this invention.
Figure 30:
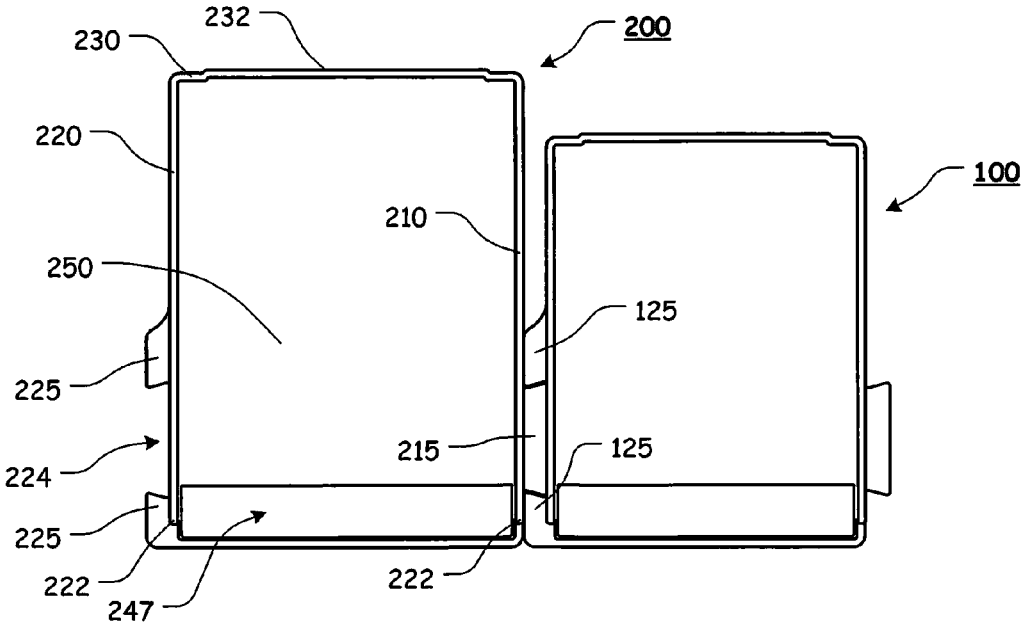
FIG. 30 illustrates a top view of a first exemplary embodiment of a stackable and linkable container horizontally linked to a second exemplary embodiment of a stackable and linkable container, according to this invention.
Figure 31:
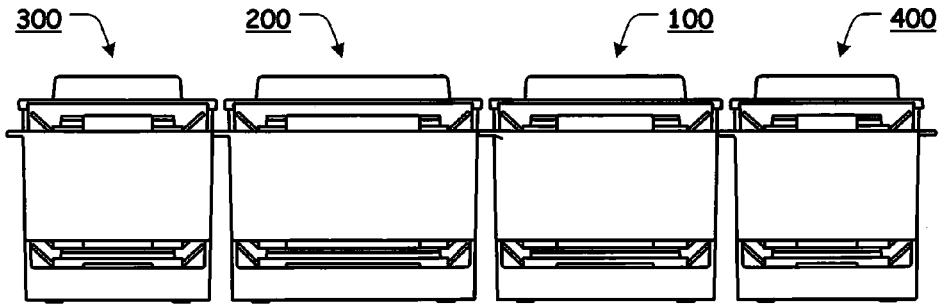
FIG. 31 illustrates a front view of multiple exemplary embodiments of a stackable and linkable container system horizontally linked together, according to this invention.
Figure 32:
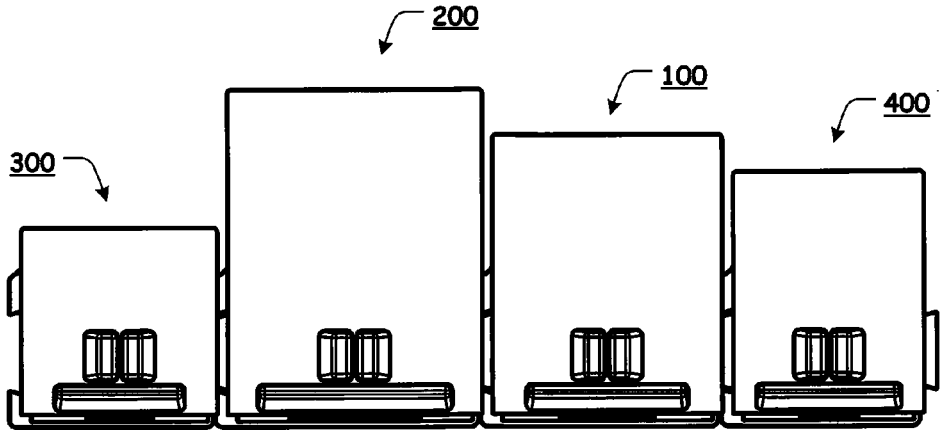
FIG. 32 illustrates a top view of multiple exemplary embodiments of a stackable and linkable container system horizontally linked together, according to this invention.

As illustrated in FIG. 28, through the mating interaction of appropriate ribs and vertical stack aligning grooves, multiple stackable and linkable container systems 100, 200, and 300 can be aligned with one another and vertically stacked atop one another.

As illustrated in FIGS. 29-32, through the alignment and interlocking of horizontal aligning dovetails (for example, horizontal aligning dovetail 215) with horizontal aligning dovetail sockets (for example, horizontal aligning dovetail socket 124), various sized stackable and linkable container systems 100, 200, 300, and/or 400 can be maintained in horizontal alignment and relationship with one another.

Thus, it should be appreciated that various stackable and linkable container systems of the present invention can be vertically and/or horizontally aligned and maintained in an interlocking relationship with each other, regardless of the overall size, shape, and dimensioning of the various stackable and linkable container systems.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

In addition, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A stackable and linkable container system, comprising:

a container having a cavity, wherein said cavity is defined by inner surfaces of a first side wall, a second side wall, a front wall, a rear wall, and a bottom wall;

an entry slot formed in at least an upper portion of said front wall;

an exit slot formed in at least a lower portion of said front wall, wherein said exit slot is formed in at least a lower portion of said front wall, a lower portion of said first side wall, and a lower portion of said second side wall;

a cover, wherein said cover is removably securable to a portion of said container via interaction between portions of said cover and mating projections extending from a forward portion of each of said opposed side walls and a portion of said rear wall;

one or more vertical stack aligning tabs extending from a top surface of said cover, wherein at least a portion of the one or more vertical stack aligning tabs defines one or more vertical stack aligning grooves;

one or more ribs extending from an outer surface of said bottom wall, wherein at least a portion of said one or more ribs is capable of being aligned with and at least partially received within a portion of said one or more vertical stack aligning grooves of a cover of an adjacent stackable container;

at least one horizontal aligning dovetail extending from said first side wall;

at least two, spaced apart, horizontal aligning pins extending from said second side wall, wherein at least one horizontal aligning dovetail socket is defined between said spaced apart horizontal aligning pins, and wherein said horizontal aligning dovetail is formed so as to be at least partially received within said horizontal aligning dovetail socket of an adjacent linkable container.

2. The stackable and linkable container system of claim 1, wherein said cavity is configured so as to contain a plurality of container lids.

3. The stackable and linkable container system of claim 1, wherein said entry slot is formed in at least an upper portion of said front wall, an upper portion of said first side wall, and an upper portion of said second side wall.

4. The stackable and linkable container system of claim 1, wherein said exit slot extends from said first side wall to said second side wall.

5. The stackable and linkable container system of claim 1, wherein said at least one horizontal aligning dovetail extends from said first side wall proximate a top portion of said first side wall.

6. The stackable and linkable container system of claim 1, wherein said horizontal aligning pins extend from said second side wall proximate a top portion of said second side wall.

7. The stackable and linkable container system of claim 1, wherein said cover includes at least one recess that allows said cover to snap fit to said mating projections extending from said forward portions of each of said opposed side walls and said mating projection extending from said portion of said rear wall.

8. The stackable and linkable container system of claim 1, further comprising a foot extending from a bottom surface of said bottom wall.

9. A stackable and linkable container system, comprising:

a container having a cavity, wherein said cavity is defined by inner surfaces of a first side wall, a second side wall, a front wall, a rear wall, and a bottom wall;

an entry slot formed in at least an upper portion of said front wall;

an exit slot formed in at least a lower portion of said front wall, wherein said exit slot is formed in at least a lower portion of said front wall, a lower portion of said first side wall, and a lower portion of said second side wall;

a cover, wherein said cover is removably securable to a portion of said container via interaction between portions of said cover and mating projections extending from a forward portion of each of said opposed side walls and a portion of said rear wall;

at least one horizontal aligning dovetail extending from said first side wall;

at least two, spaced apart, horizontal aligning pins extending from said second side wall, wherein at least one horizontal aligning dovetail socket is defined between said spaced apart horizontal aligning pins, and wherein said horizontal aligning dovetail is formed so as to be at least partially received within said horizontal aligning dovetail socket of an adjacent linkable container.

10. The stackable and linkable container system of claim 9, wherein said cavity is configured so as to contain a plurality of container lids.

11. The stackable and linkable container system of claim 9, wherein said entry slot is formed in at least an upper portion of said front wall, an upper portion of said first side wall, and an upper portion of said second side wall.

12. The stackable and linkable container system of claim 9, wherein said exit slot extends from said first side wall to said second side wall.

13. The stackable and linkable container system of claim 9, wherein said at least one horizontal aligning dovetail extends from said first side wall proximate a top portion of said first side wall.

14. The stackable and linkable container system of claim 9, wherein said horizontal aligning pins extend from said second side wall proximate a top portion of said second side wall.

15. The stackable and linkable container system of claim 9, wherein said cover includes at least one recess that allows said cover to snap fit to said mating projections extending from said forward portions of each of said opposed side walls and said mating projection extending from said portion of said rear wall.

16. A stackable and linkable container system, comprising:

a container having a cavity, wherein said cavity is defined by inner surfaces of a first side wall, a second side wall, a front wall, a rear wall, and a bottom wall;

an entry slot formed in at least an upper portion of said front wall;

an exit slot formed in at least a lower portion of said front wall, wherein said exit slot is formed in at least a lower portion of said front wall, a lower portion of said first side wall, and a lower portion of said second side wall;

a cover, wherein said cover is removably securable to a portion of said container via interaction between portions of said cover and mating projections extending from a forward portion of each of said opposed side walls and a portion of said rear wall;

one or more vertical stack aligning tabs extending from a top surface of said cover, wherein at least a portion of the one or more vertical stack aligning tabs defines one or more vertical stack aligning grooves; and one or more ribs extending from an outer surface of said bottom wall, wherein at least a portion of said one or more ribs is capable of being aligned with and at least partially received within a portion of said one or more vertical stack aligning grooves of a cover of an adjacent stackable container.

17. The stackable and linkable container system of claim 16, wherein said cavity is configured so as to contain a plurality of container lids.

18. The stackable and linkable container system of claim 16, wherein said entry slot is formed in at least an upper portion of said front wall, an upper portion of said first side wall, and an upper portion of said second side wall.

19. The stackable and linkable container system of claim 16, wherein said exit slot extends from said first side wall to said second side wall.

20. The stackable and linkable container system of claim 16, wherein said cover includes at least one recess that allows said cover to snap fit to said mating projections extending from said forward portions of each of said opposed side walls and said mating projection extending from said portion of said rear wall.

* * * * *